US008678504B1

(12) United States Patent
Bakker et al.

(10) Patent No.: US 8,678,504 B1
(45) Date of Patent: Mar. 25, 2014

(54) SEAT ASSEMBLY FOR CHAIR

(75) Inventors: Mitch Bakker, Holland, MI (US); Walt Gurdak, Grand Rapids, MI (US)

(73) Assignee: IDA Design LLC, Zeeland, MI (US)

( * ) Notice: Subject to any disclaimer, the term of this patent is extended or adjusted under 35 U.S.C. 154(b) by 443 days.

(21) Appl. No.: 12/880,409

(22) Filed: Sep. 13, 2010

Related U.S. Application Data

(60) Provisional application No. 61/241,482, filed on Sep. 11, 2009.

(51) Int. Cl.
*A47C 7/02* (2006.01)

(52) U.S. Cl.
USPC ..... 297/452.12; 297/440.14; 297/440.2; 297/440.22

(58) Field of Classification Search
USPC ..... 297/452.14, 440.14, 440.2, 440.22
See application file for complete search history.

(56) References Cited

U.S. PATENT DOCUMENTS 3,393,941 A * 7/1968 Grosfillex ..... 297/440.22
3,647,260 A * 3/1972 Grant et al. ..... 297/229
3,734,561 A * 5/1973 Barecki et al. ..... 297/239
3,758,159 A * 9/1973 Morris ..... 297/452.14
3,788,701 A * 1/1974 Massaccesi ..... 297/452.2
3,841,704 A * 10/1974 Platner et al. ..... 297/452.55
4,073,539 A * 2/1978 Caruso ..... 297/452.14
4,123,105 A * 10/1978 Frey et al. ..... 297/451.1
5,044,694 A * 9/1991 Koa ..... 297/452.12
5,110,186 A * 5/1992 Clark et al. ..... 297/440.2
8,096,621 B2 * 1/2012 Braun ..... 297/440.15

* cited by examiner

*Primary Examiner* — Sarah B McPartlin
(74) *Attorney, Agent, or Firm* — McGarry Bair PC

(57) ABSTRACT

A seat assembly includes a molded plastic shell and an embedded frame. The seat assembly can include a seat bottom and a seat back which are connected by a curved backstop. The curve of the backstop is dictated by the embedded frame. The seat assembly can be part of a modular chair system, in which the seat assembly can be attached to a chair base, without or without optional arms. The seat assembly can be transferred between a low density stacking chair base and a high density stacking chair base without modification of the seat assembly. The arms can be attached to the chair base without modification of the chair base. A method for attaching a seat assembly to a chair base is also provided.

17 Claims, 16 Drawing Sheets

SEAT ASSEMBLY FOR CHAIR

CROSS REFERENCE TO RELATED APPLICATION

The present application claims the benefit of U.S. Provisional Patent Application No. 61/241,482, filed Sep. 11, 2009, which is incorporated herein by reference in its entirety.

BACKGROUND

Chairs that are used only occasionally are frequently stored when not in use. Different chair designs have been developed that reduce the amount of space required for storage, and which enable easier transport. One example is a folding chair, where the chair may be folded or collapsed. Another example is a stacking chair, where the chair may be stacked with other similar chairs. A stacking chair can be configured to stack on the legs of another similar chair, or can be configured to closely nest, such that the seat bottoms and seat backs of stacked chairs are very close to each other, often with at least some contact between the seat bottoms and seat backs. With any of these chairs, it is a challenge to provide a structural design that provides compact storage while also providing an ergonomically comfortable chair. Another constraint is the cost required to manufacture and ship chairs, which also must be considered along with comfort and storability.

BRIEF DESCRIPTION OF THE INVENTION

The invention generally relates to a seat assembly for a chair, a modular chair assembly including a seat assembly, and a method of assembly for attaching a seat assembly to a chair base.

In one aspect, the invention relates to a seat assembly for mounting to a chair base to form a chair. The seat assembly comprises a single molded plastic shell having a seat bottom and a seat back extending upwardly from the seat bottom, and a frame embedded in the shell and having a seat bottom portion and a seat back portion extending upwardly from the seat bottom portion.

In another aspect, the invention relates to a modular chair system that comprises one or more chair bases, each having a frame for supporting the chair base on a floor surface and at least one bracket attached to an upper portion of the frame. A seat assembly is selectively mounted to and supported by one of the chair bases. The seat assembly comprises a seat bottom, a seat back extending upwardly from the seat bottom, and at least one mounting member on an underside of the seat bottom for coupling to the brackets.

In yet another aspect, the invention relates to a method for attaching a seat assembly to a chair base. The method includes partially lowering a seat assembly toward the chair base, where the seat assembly has a seat bottom, a seat back extending upwardly from the seat bottom, and a mounting member on an underside of the seat bottom, and the chair base has a bracket with a mounting portion corresponding to the mounting member, inserting the mounting portion into the mounting member by moving the seat assembly and the chair base relative to each other, fully lowering the seat assembly toward the chair base, and fixing the position of the seat assembly on the chair base.

DETAILED DESCRIPTION OF THE INVENTION

The subject matter disclosed herein relates to a seat assembly for a chair, and more particularly to a method of making a seat assembly, and a structure and a method of assembly for attaching the seat assembly to a chair base. The subject matter disclosed herein further relates to a modular chair system including a seat assembly and one or more chair bases, with other optional components. As used herein, the term "chair" includes a first portion on which a user sits, such as a chair seat assembly, and a second portion which supports the first portion above a surface on which the second portion rests, such as a chair base.

As used herein, "vertical" is defined as being in a position or direction perpendicular to the plane defined by the surface on which a chair rests. "Forward" or "front" is defined as being in a position or direction toward that which a user faces when seated normally in a chair. "Rearward" or "rear" is defined as being in a position or direction opposite that which a user faces when seated normally in a chair. "Right" and "left" are defined from the front of the seat assembly 10.

Figure 2:
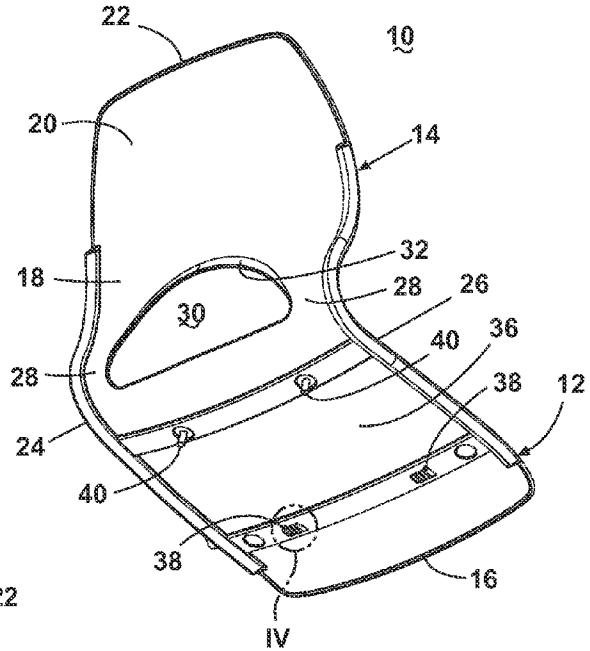
FIG. 2 is a rear perspective view of the seat assembly from FIG. 1.
Figure 1:
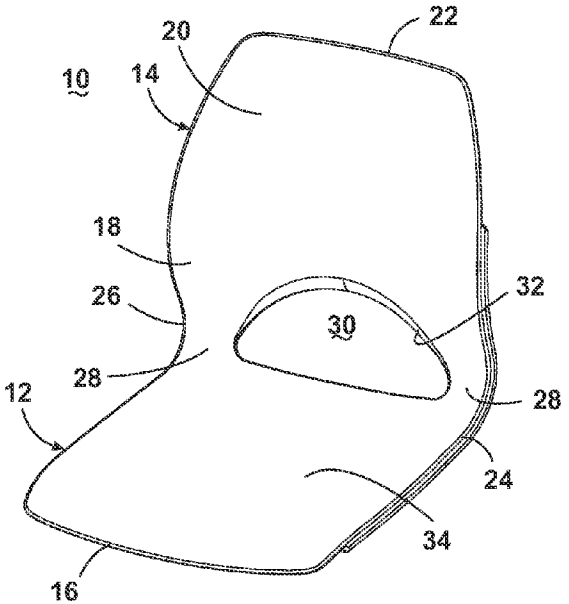
FIG. 1 is a front perspective view of a seat assembly according to one embodiment of the invention.
Figure 3:
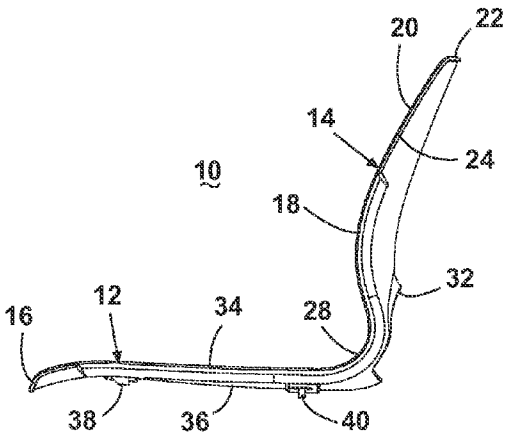
FIG. 3 is a side view of the seat assembly from FIG. 1.

Referring to FIGS. 1-3, a seat assembly 10 according to one embodiment of the invention is shown. The seat assembly 10 is capable of being attached to a chair base (not shown in FIG. 1), as is described below, for use as a chair. The seat assembly 10 comprises a generally horizontal seat bottom 12 and a seat back 14 formed integrally with the seat bottom 12 and extending generally upwardly from the seat bottom 12. The seat bottom 12 can be slightly concave to provide an ergonomically comfortable surface on which a user can sit, and may have a forward edge 16 that can be flared downwardly to provide a comfortable edge to the seat bottom 12. The seat back 14 can include a generally convex lower portion 18 to provide lumbar support to a user seated on the seat assembly 10, and an upper portion 20 that curves backwardly of the lower portion 18 and has an upper edge 22. Like the forward edge 16, the upper edge 22 can be flared backwardly to provide a comfortable edge to the seat back 14. The forward edge 16 and the upper edge 22 are connected by a right lateral side edge 24 and a left lateral side edge 26. Either side edge 24, 26 can also be flared downwardly and/or backwardly to provide a comfortable lateral side edge to the seat bottom 12 and seat back 14. A curved backstop 28 is formed between the seat bottom 12 and the lower portion 18 of the seat back 14 and serves to connect the seat bottom 12 and seat back 14.

The seat assembly 10 can include at least one opening 30 to provide ventilation or air circulation to a user seated on the seat assembly 10. The opening 30 can also be used as a place to grip the seat assembly 10 to lift or move the seat assembly 10. Such an opening 30 also reduces the overall weight of the seat assembly 10, which is a valuable feature when transporting the seat assembly 10 or stacking multiple chairs comprising the seat assembly 10. As illustrated, the seat back 14 of the seat assembly 10 includes one opening 30 defined by a continuous boundary edge 32. The opening 30 is generally semicircular in shape and is located partially on the lower portion 18 and partially on the backstop 28. In this position, the opening 30 will generally coincide with a lower back of a user seated on the seat assembly 10. Like the forward, upper, and lateral side edges 16, 22, 24, 26, the boundary edge 32 can be flared backwardly to provide a comfortable edge to the opening 30.

While not illustrated, the seat back 14 may alternately comprise multiple openings of varying shape, such as slots or holes. Furthermore, the seat bottom 12 may be provided with at least one opening in addition to or instead of any openings in the seat back 14.

The seat assembly 10 includes a front or user surface 34 and a back or non-user surface 36. The front surface 34, which is best seen in FIG. 1, can be considered a user surface since this is the surface a user will contact when sitting on the seat assembly 10. The front surface 34 is generally smooth over the seat bottom 12, the seat back 14, and the backstop 28. While not illustrated, the front surface 34 may be provided with padding and/or upholstery to add cushion and/or decoration to the seat assembly 10.

Referring to FIG. 2, the back surface 36 of the seat assembly 10 is also generally smooth, but includes features related to the attachment of the seat assembly 10 to a chair base and features related to the formation of the seat assembly 10. As illustrated herein, the features related to the attachment of the seat assembly 10 to a chair base include two mounting members 38 and two studs 40, which may be threaded. The two mounting members 38 are spaced from each other and are positioned forwardly of the studs 40. Likewise, the two studs 40 are spaced from each other, and positioned closer to the backstop 28 than the mounting members 38.

Figure 4:
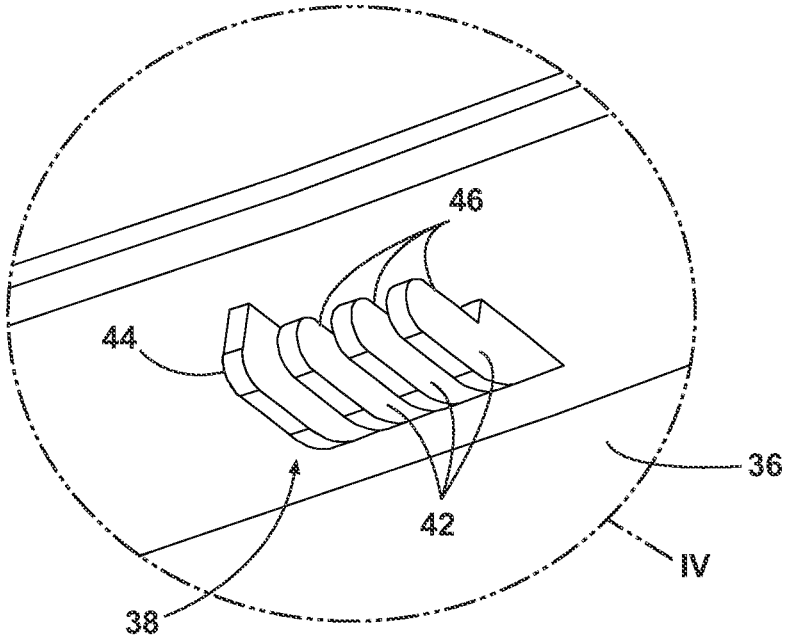
FIG. 4 is a close-up view of section IV from FIG. 2.

Referring to FIG. 4, a close of view of the mounting member 38 closest to the right lateral side edge 24 of the seat assembly 10 is shown. The mounting member 38 includes at least one mounting tooth 42 and at least one lateral movement preventer 44. The mounting tooth 42 and the lateral movement preventer 44 can each comprise a flange extending from the back surface 36 of the seat bottom 12. The flanges can be generally parallel to each other, and may be generally coextensive in length. The main difference between a flange being mounting tooth 42 and a flange being a movement preventer 44 is that a flange that forms a mounting tooth 42 has a notch 46 opening in the rearward direction, and a flange that forms a lateral movement preventer 44 does not have a notch.

As illustrated herein, there are three spaced mounting teeth 42 and one lateral movement preventer 44. The lateral movement preventer 44 is positioned closest to the right lateral side edge 24, and the mounting teeth 42 are spaced inwardly therefrom. As will be described in further detail below, the inclusion of a lateral movement preventer 44 comprising an unnotched flange will prevent lateral movement or shifting of the seat assembly 10 relative to a chair base. The mounting member 38 closest to the left lateral side edge 24 of the seat assembly 10 is a mirror image of the mounting member 38 shown in FIG. 4, i.e., the lateral movement preventer 44 is positioned closest to the left lateral side edge 26, and the mounting teeth 42 are spaced inwardly therefrom, and will not be individually described herein.

As shown in FIG. 3, the seat bottom 12, the seat back 14, and the backstop 28 are integrally formed with each other. The backstop 28 forms a sharp curve between the seat bottom 12 and the lower portion 18, and includes a rearward bulge that extends rearwardly of the seat bottom 12 and curves back forwardly to join the lower portion 18. For example, the curve of the backstop 28 can have a radius of about 180 mm. The strong curve of the backstop 28 provides uncommon comfort and ergonomic benefit to the seat assembly 10 and is made possible by the structure of the seat assembly 10 and the manufacturing process used to make the seat assembly 10. The comfort level and ergonomic benefit of the backstop 28 is on par with other typical swivel-type chairs and low density chairs, but exceeds that of typical high density chairs.

Figure 6:
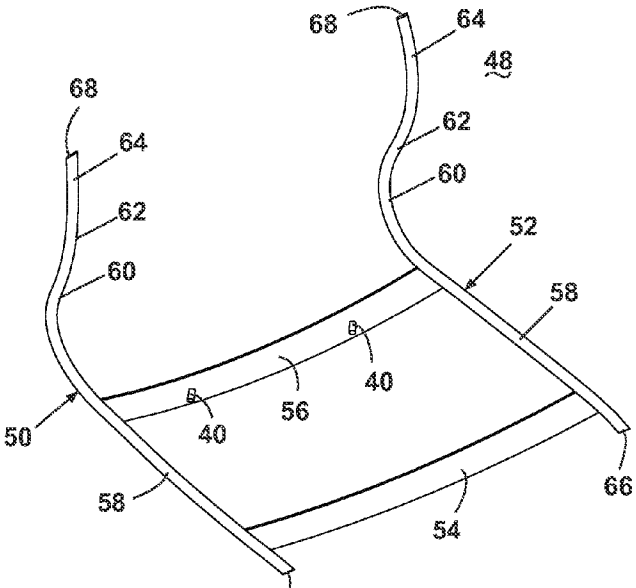
FIG. 6 is a rear perspective view of the frame from FIG. 5.
Figure 5:
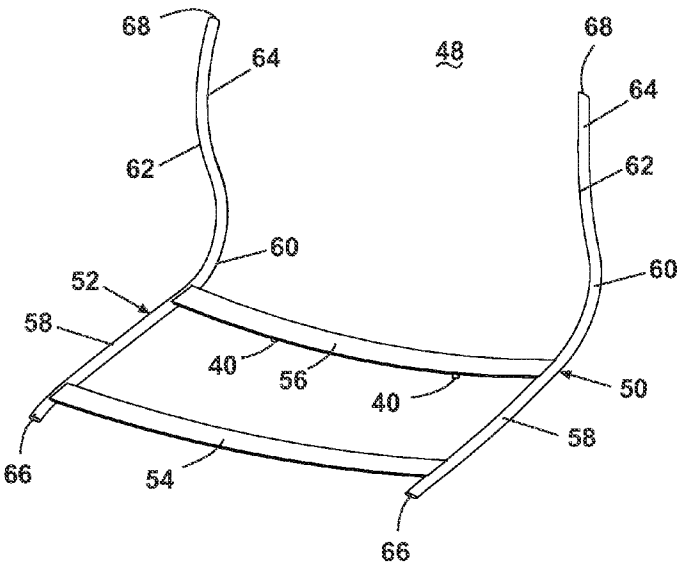
FIG. 5 is a front perspective view of a frame for the seat assembly of FIG. 1.
Figure 7:
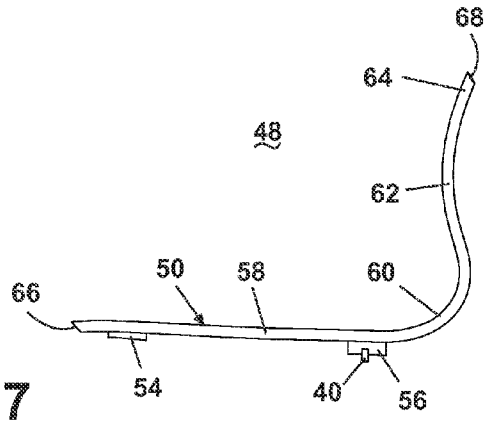
FIG. 7 is a side view of the frame from FIG. 5.

Specifically, the strong curve of the backstop 28 is made possible by using an embedded frame 48 which is overmolded to create a shell over the frame 48, as will be described below, thus creating the seat assembly 10. The frame 48, shown in FIGS. 5-7, comprises a right lateral support member 50 and a left lateral support member 52 which is connected to the right lateral support member 50 by a forward strut 54 and a rearward strut 56. In general, the frame 48 defines or gives shape to the seat assembly 10. The right and left lateral support members 50, 52 can be identical to each other, or can be mirror images of each other. Each support member 50, 52 includes a seat bottom portion 58, a backstop portion 60, a lower seat back portion 62, and an upper seat back portion 64. The seat bottom portion 58 and the upper seat back portion 64 each include a free end 66, 68, respectively.

The seat bottom portion 58 in combination with the struts 54, 56 give shape to the seat bottom 12 of the seat assembly 10. The backstop portion 60 defines the strong curve of the backstop 28. The seat back portions 62, 64 give shape to the seat back 14, with the lower seat back portion 62 defining the shape or curve of the lower potion 18 and the upper seat back portion 64 defining the shape or curve of the upper portion 20.

The struts 54, 56 extend between the seat portions 58 of the support members 50, 52, and can be attached thereto using any suitable attachment method, such as by welding. Each strut 54, 56 can be a generally flat strip of material that has a slight downward curve, the lowest point of the curve generally coinciding with the midpoint of the strut 54, 56. As illustrated in FIG. 2, the studs 40 can be positioned on the frame 48, and project downwardly from the underside of the rearward strut 56.

The frame 48 can be constructed from any material having suitable properties for the contemplated use as a supporting structure of the seat assembly 10, and can be integrally formed in one-piece or made from multiple pieces attached together. In one example, the frame 48 can be constructed of steel, with the lateral support members 50, 52 comprising 7/16 inch round rod stock and the struts 54, 56 comprising flat bar stock welded to the support members 50, 52. The studs 40 can be separately welded to the rearward strut 56.

Figure 8:
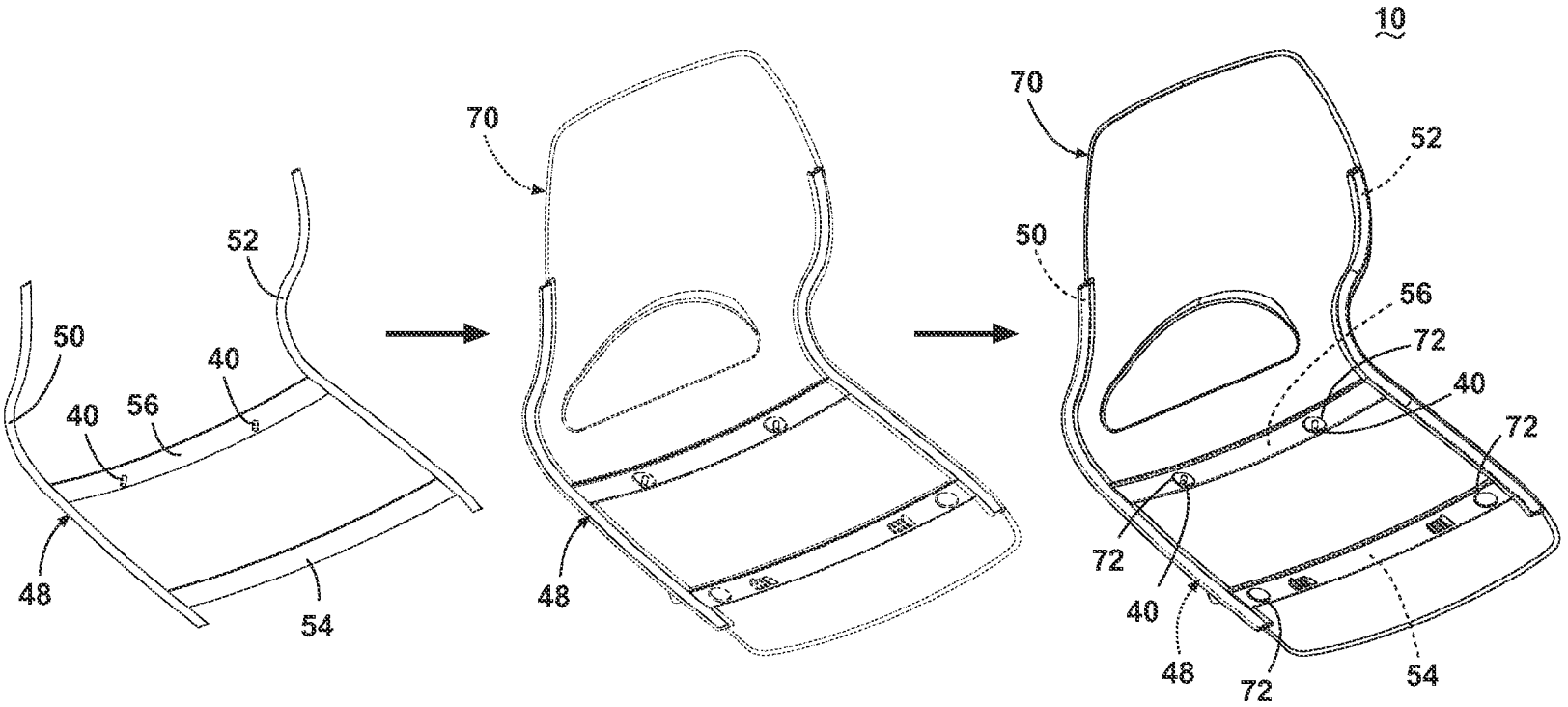
FIG. 8 is a schematic illustration of a sequence of steps for producing the seat assembly from FIG. 1.

Referring to FIG. 8, a sequence of steps for producing the seat assembly 10 is schematically illustrated. The seat assembly 10 can comprise a molded chair shell 70 in which the frame 48 is embedded. The frame 48 can be embedded in the chair shell 70 by overmolding. First the frame 48 is inserted into a mold. The material for the shell is introduced into the mold. The material is allowed to cool and harden, thereby forming the chair shell 70. The chair shell 70 can be configured to substantially encase the frame 48, save for a few exposed areas 72 which are used to handle the finished seat assembly 10 as it comes out of the mold. As illustrated, the seat assembly 10 includes four locations where the frame 48 is exposed after overmolding; two locations on the forward strut 54 and two locations on the rearward strut 56 surrounding the studs 40. The chair shell 70 can be molded from any suitable material, such as, but not limited, to polypropylene.

Figure 15:
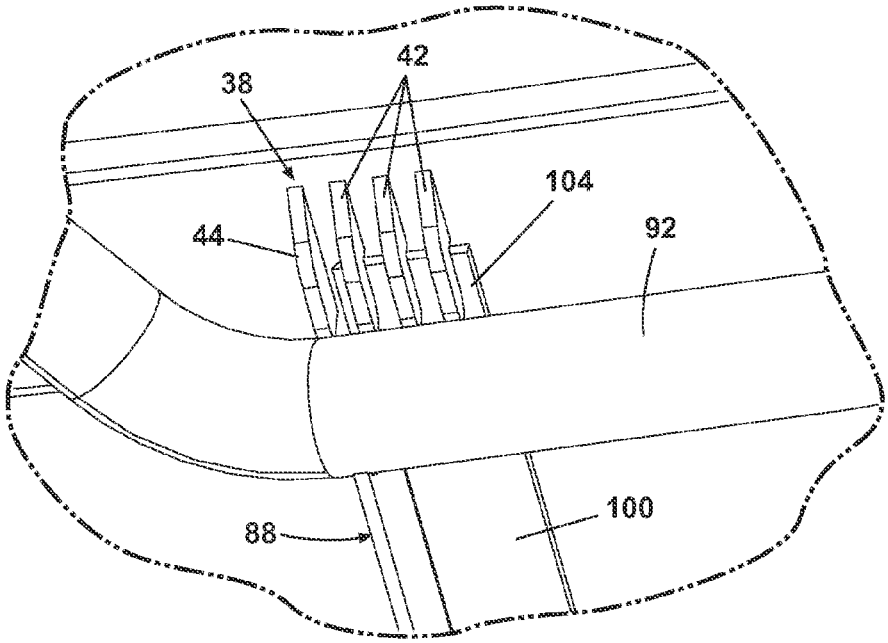
Figure 16:
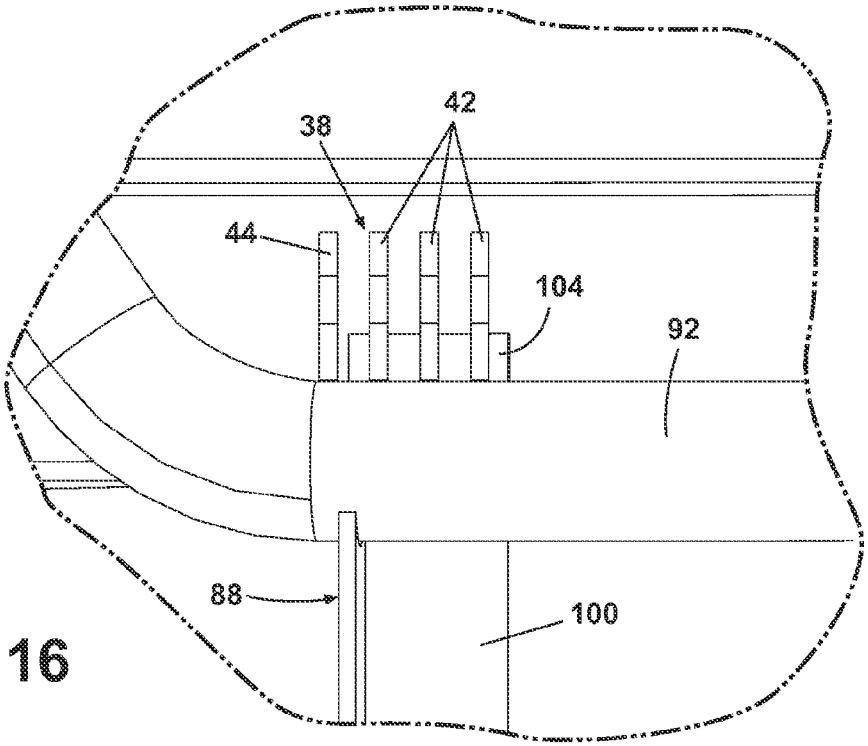
Figure 17:
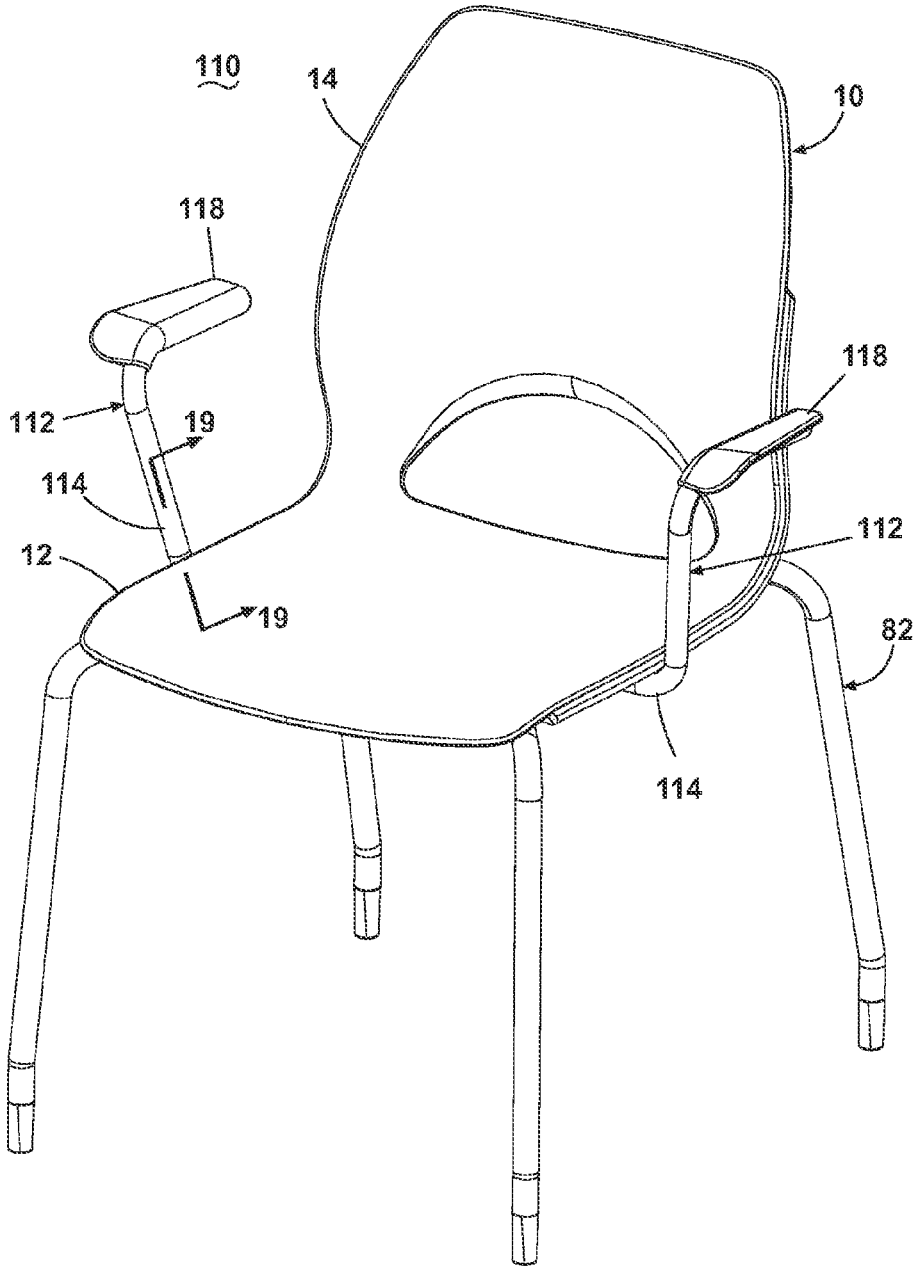
FIG. 17 is a perspective view of a second embodiment of a chair according to the invention having the seat assembly from FIG. 1 attached to a tubular frame chair base having arms.
Figure 18:
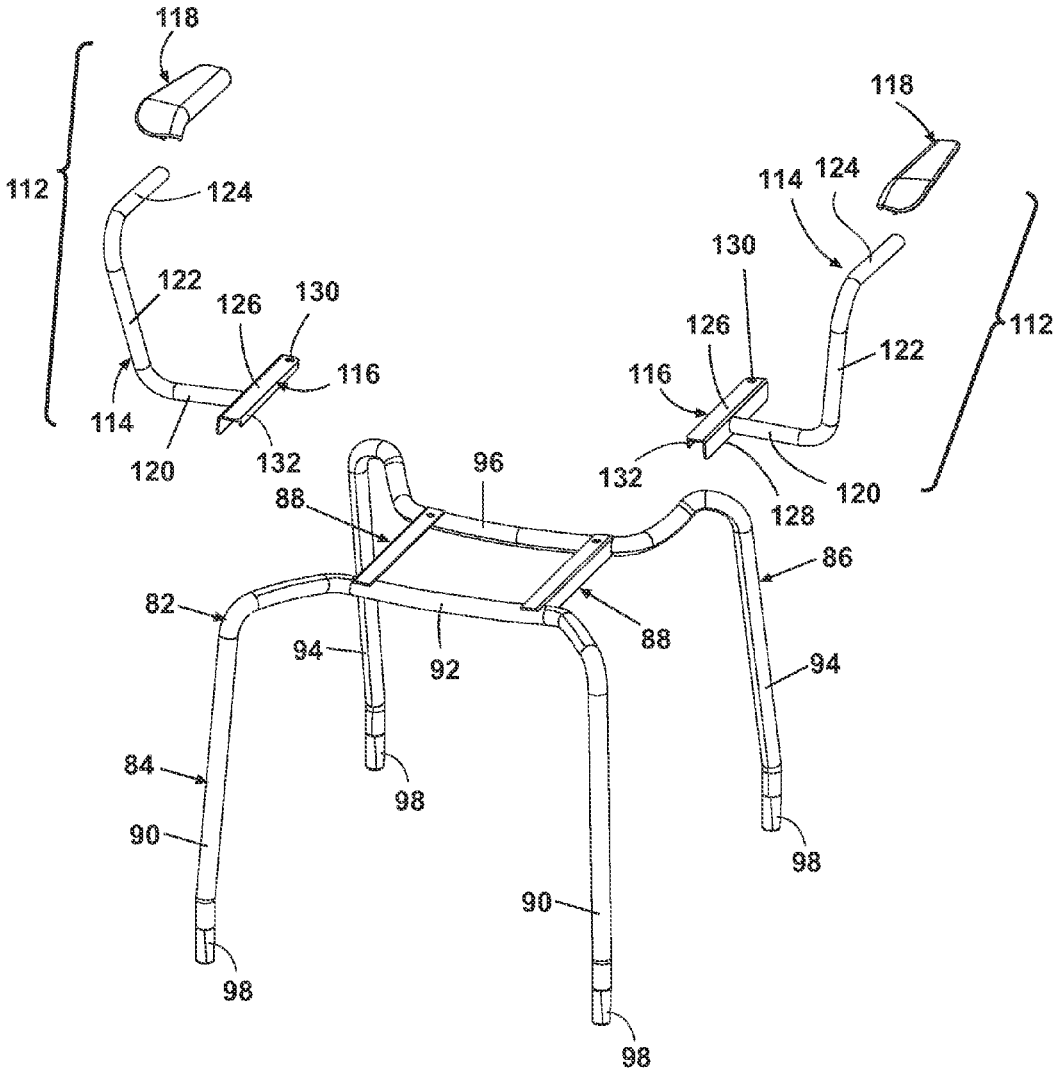
FIG. 18 is an exploded perspective view of the chair base from FIG. 17.
Figure 19:
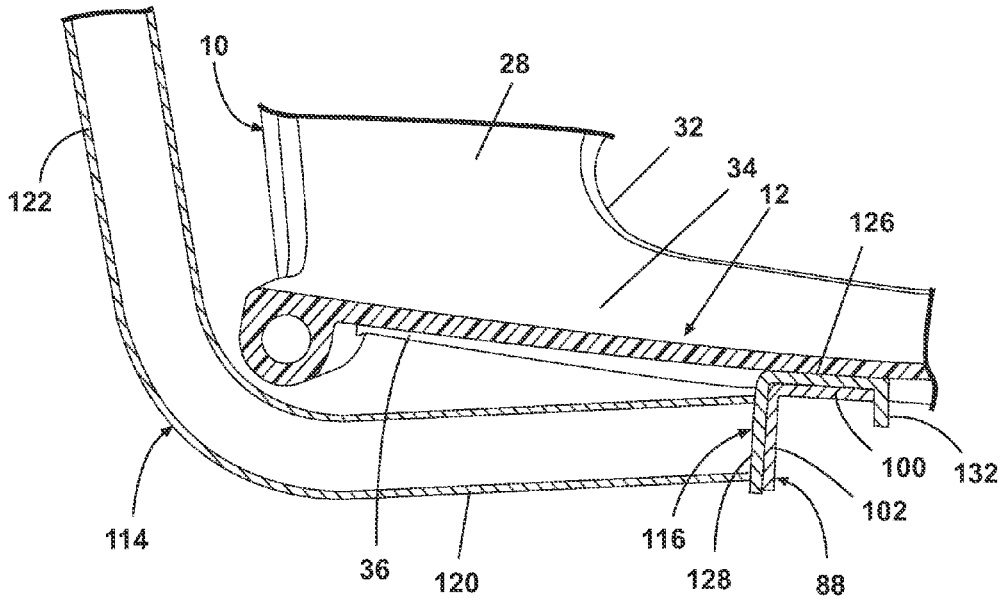
FIG. 19 is a cross-sectional view through line 19-19 of FIG. 17.
Figure 20:
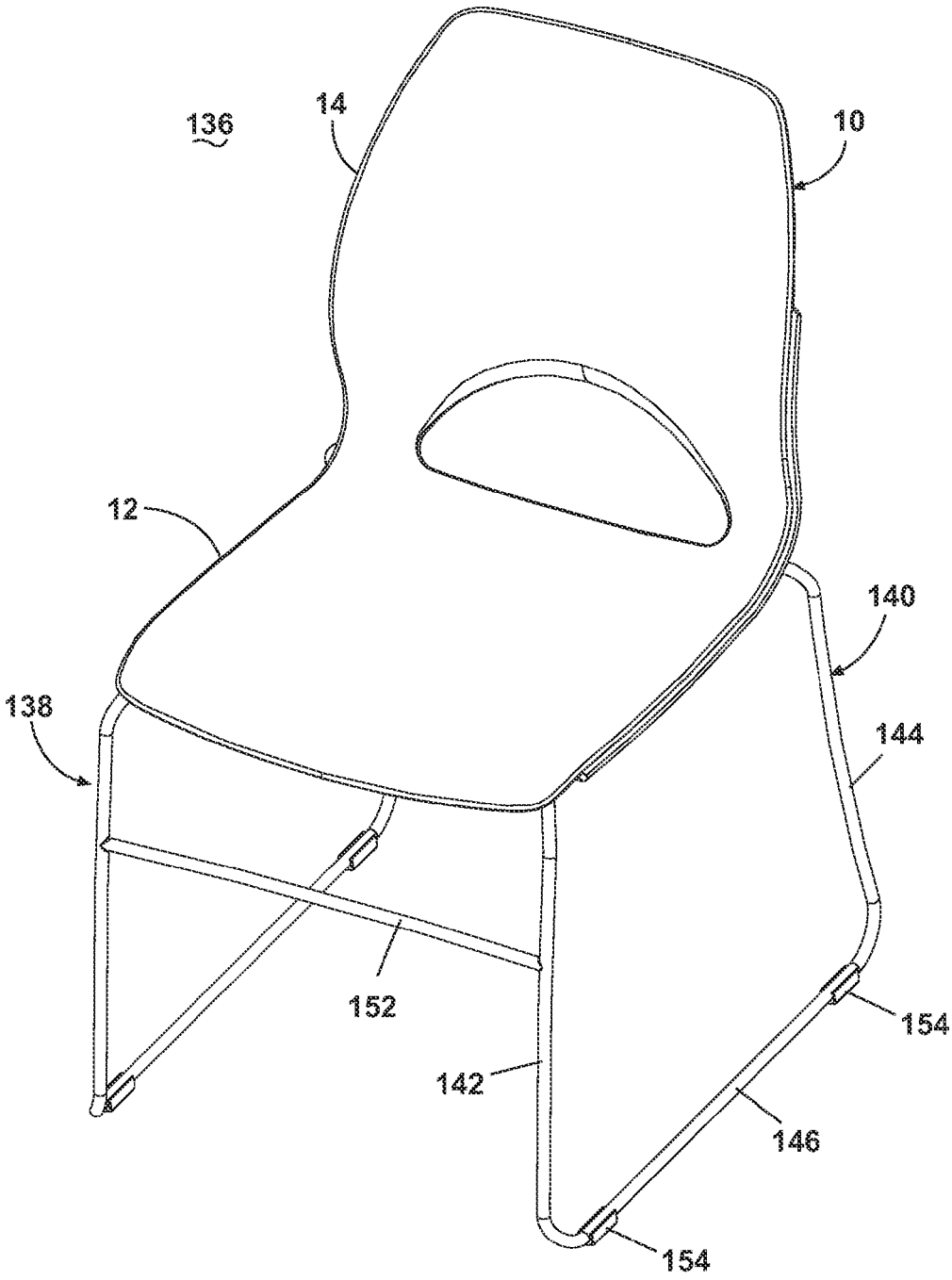
FIG. 20 is a perspective view of a third embodiment of a chair according to the invention having the seat assembly from FIG. 1 attached to a wire frame chair base.
Figure 21:
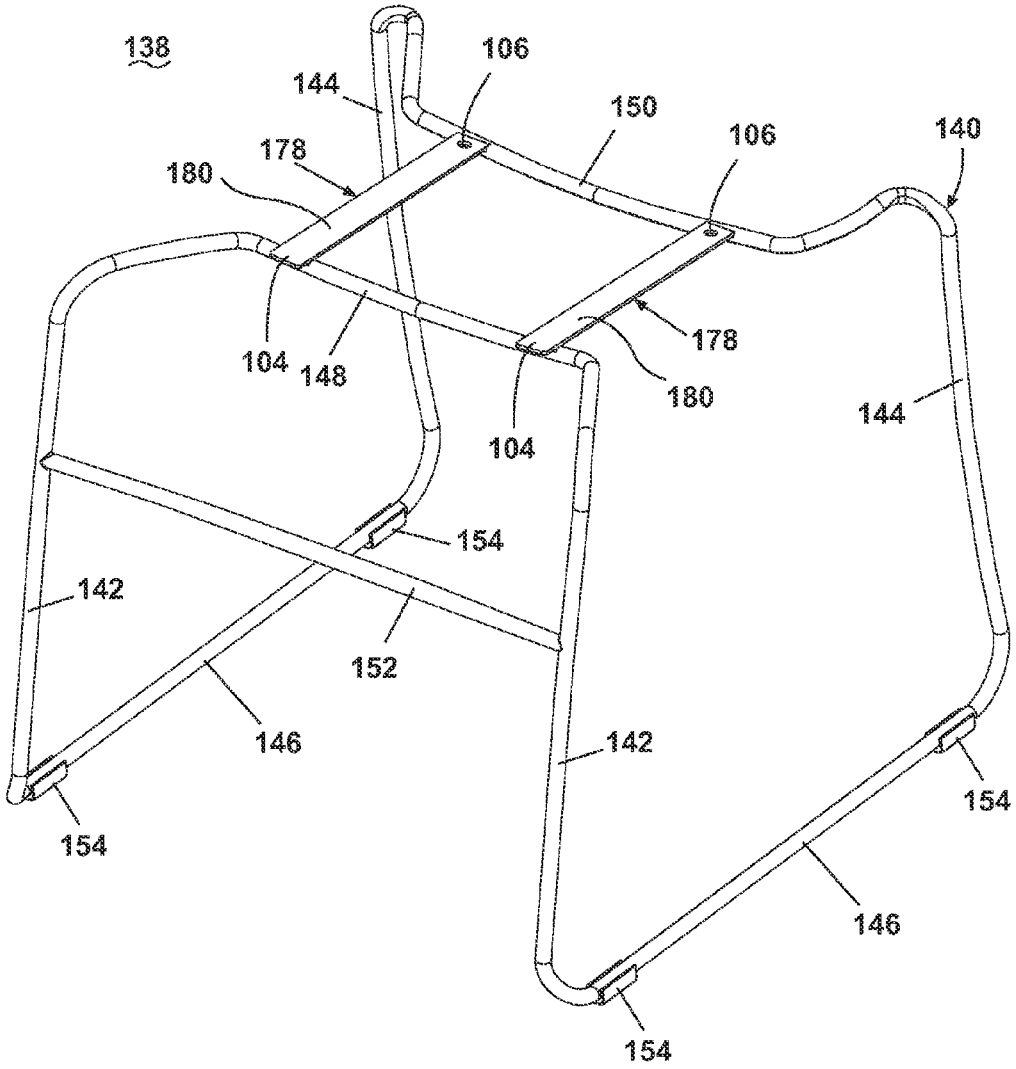
FIG. 21 is a perspective view of the chair base from FIG. 20.
Figure 23:
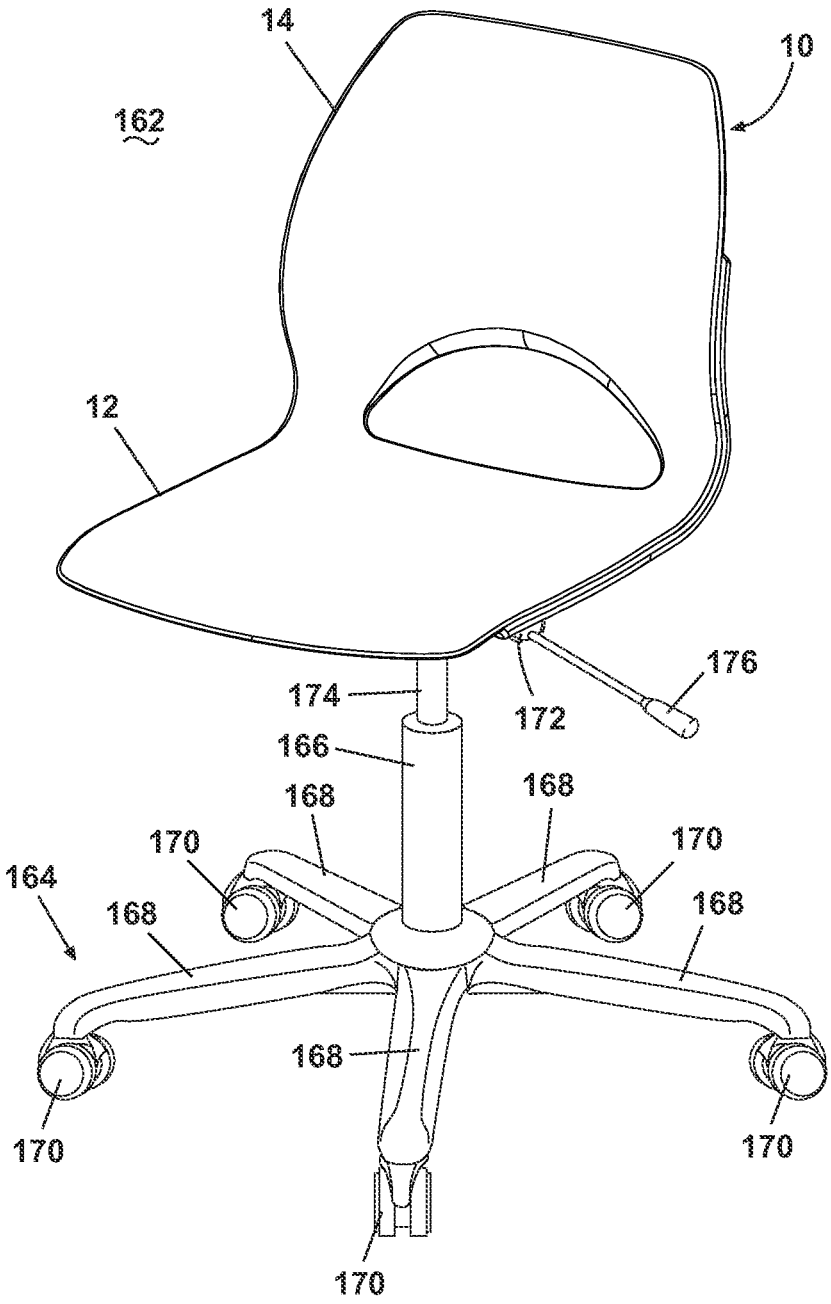
FIG. 23 is a perspective view of a fourth embodiment of a chair according to the invention having the seat assembly from FIG. 1 attached to a swivel-type chair base.

As mentioned above, the seat assembly 10 can be attached to a chair base for use as a chair. The remaining drawings illustrate some embodiments of chairs comprising the seat assembly 10. Specifically, FIGS. 9-16 illustrate a low density stacking chair 80 without arms, FIGS. 17-19 illustrate a low density stacking chair 110 having arms, FIGS. 20-21 illustrate a high density stacking chair 136, and FIG. 23 illustrates a swivel-type chair 162.

Figure 9:
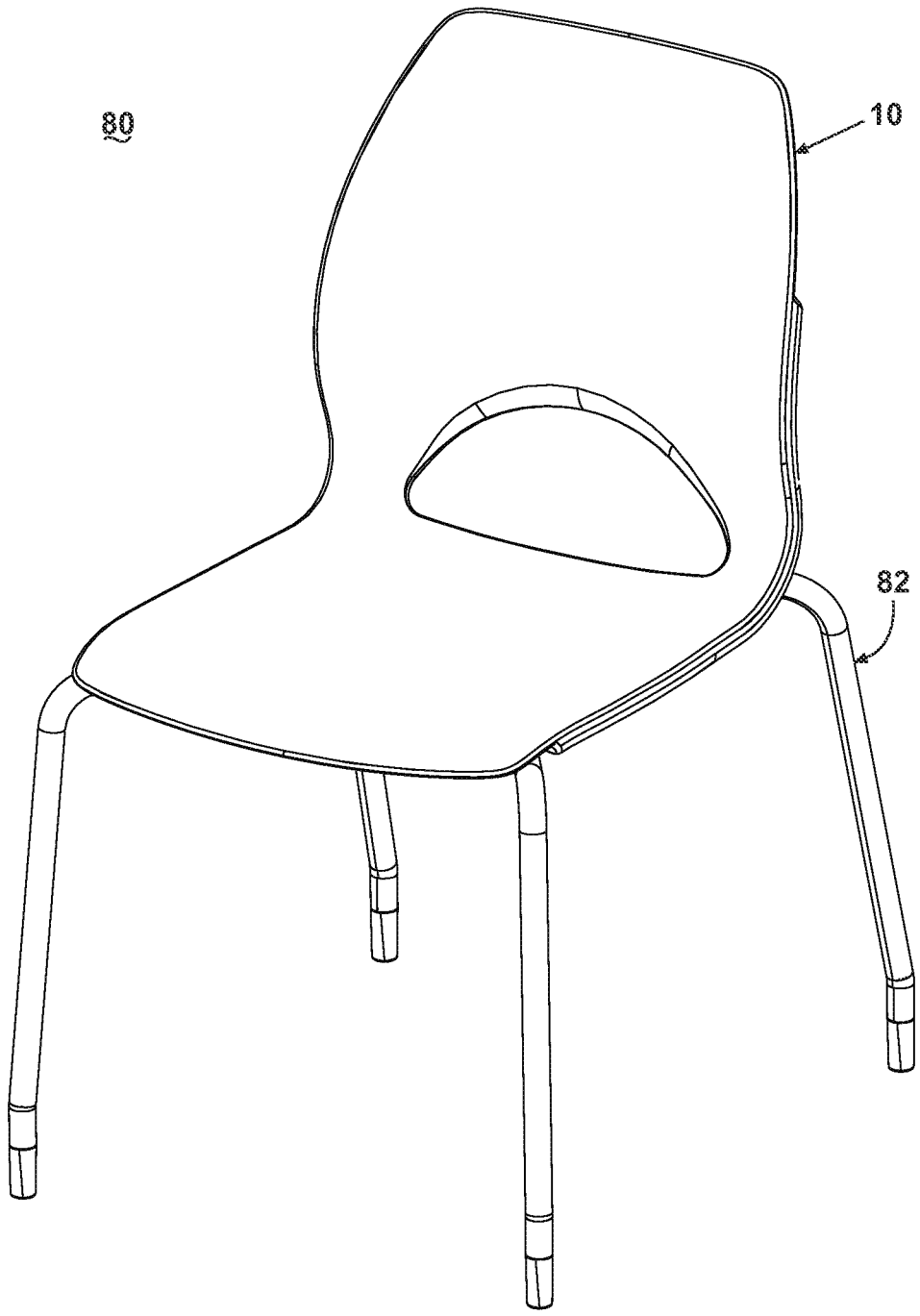
FIG. 9 is a perspective view of a first embodiment of a chair according to the invention having the seat assembly from FIG. 1 attached to a tubular frame chair base.
Figure 10:
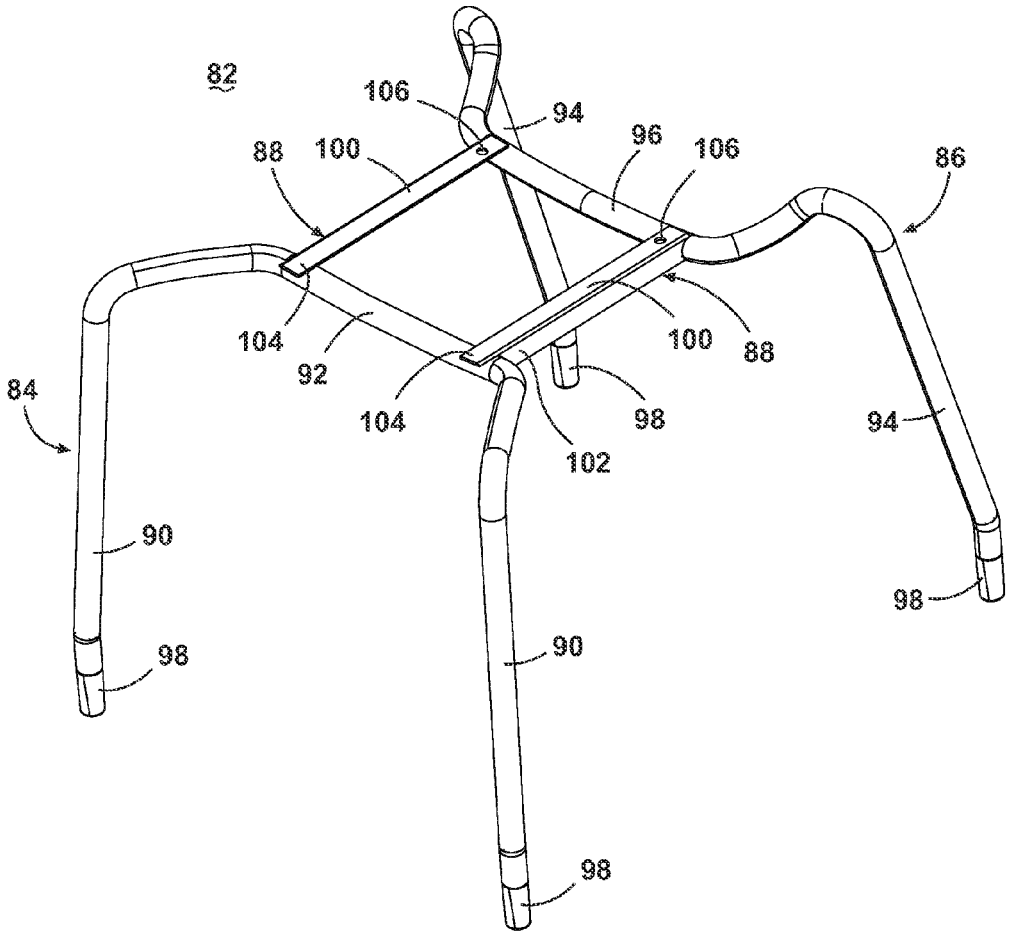
FIG. 10 is a perspective view of the chair base from FIG. 9.
Figure 11:
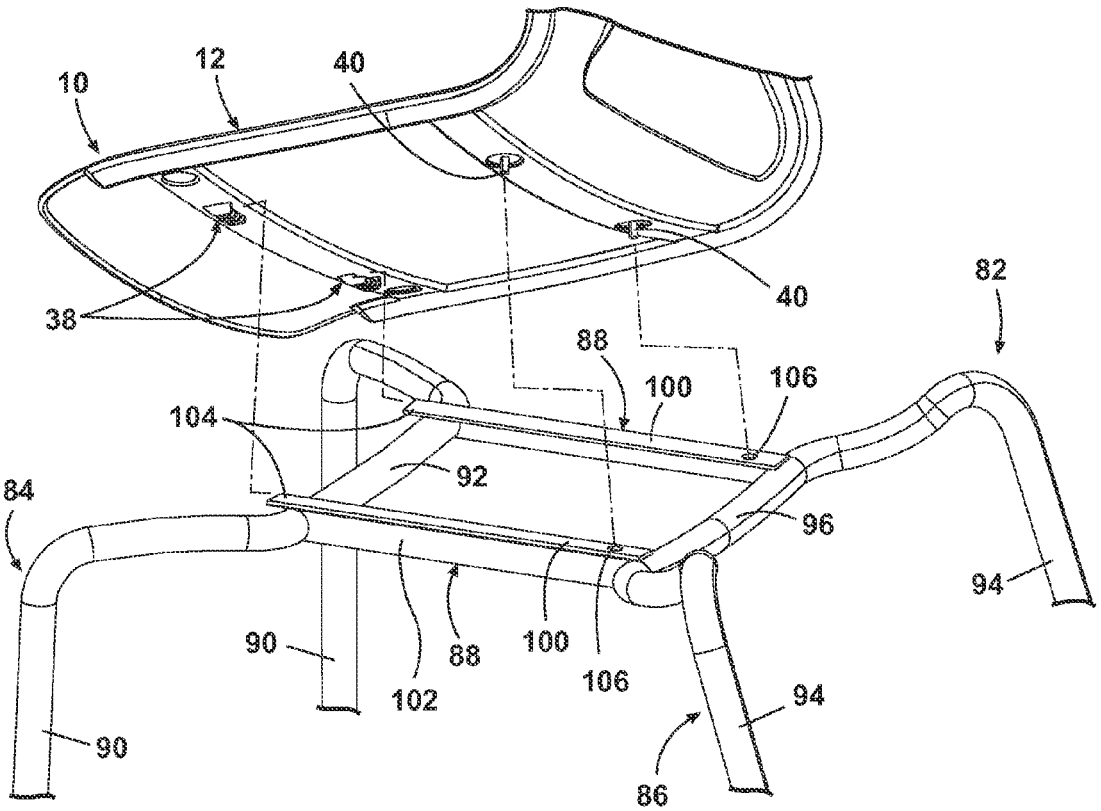
FIG. 11 is a partial exploded view of the chair from FIG. 9.

FIGS. 9-11 show a first embodiment of a chair 80 according to the invention having the seat assembly 10 from FIG. 1 attached to a chair base 82. The chair base 82 comprises a tubular frame having multiple legs. As used herein, the term "tubular" refers to the cross sectional shape of the material used in forming the frame rather than the shape of the frame itself; e.g., the tubular frame is formed from a cylindrical or tube-shaped material that is formed into the shape illustrated in the drawings.

Referring to FIG. 10, the tubular frame of the chair base 82 may be formed as one piece or as several pieces which are attached to each other. Here, the tubular frame has been formed as several pieces, and includes a front frame member 84 and a rear frame member 86, which are connected by a pair of brackets 88. The front frame member 84 includes two complementary forward legs 90 which are joined by a forward seat support 92. The rear frame member 86 includes two complementary rearward legs 94 which are joined by a rearward seat support 96. The legs 90, 94 can be inclined with respect to vertical. Each leg 90, 94 can be provided with a glide 98 at its lower free end that permits the chair 80 to be moved without damaging a flooring surface. Alternately, each leg 90, 94 could be provided with a wheel or caster (not shown) in place of the glides 98.

Referring to FIG. 11, the front and rear frame members 84, 86 are joined together in spaced relation to each other by the brackets 88, which extend between the forward and rearward seat supports 92, 96. The brackets 88 can have any suitable cross-sectional configuration, such as, but not limited to L-shaped, J-shaped, U-shaped, or flat. As illustrated, the brackets 88 can be L-shaped brackets, with a flat top wall 100 and a flat side wall 102. A semi-circular cut-out can be made at each end of the bracket 88 so that the bracket 88 may closely fit against the tubular frame of the seat supports 92, 96. The brackets 88 further comprise a mounting portion illustrated as an extension 104 of the top wall 100 that extends forwardly beyond the forward seat support 92. The extensions 104 are configured to be slidably received by the mounting members 38. A through-hole 106 is formed in the top wall 100 near the junction of the bracket 88 with the rear frame member 86, and is configured to receive one of the studs 40 on the seat assembly 10.

Figure 12:
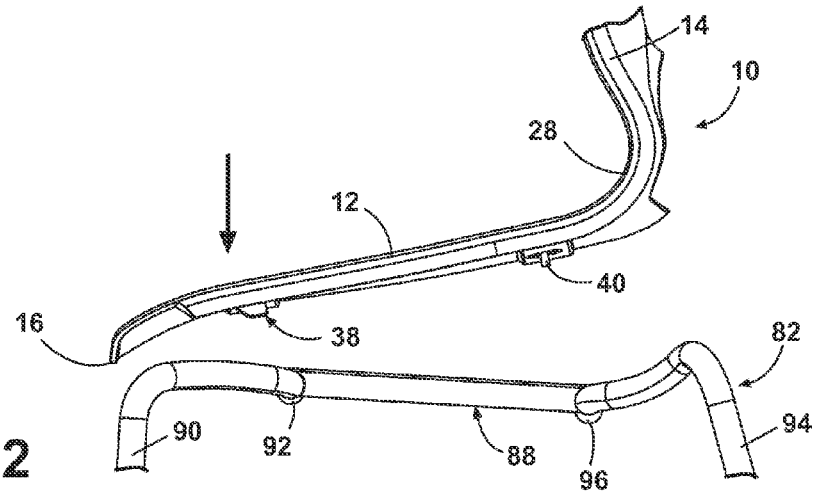
FIGS. 12-16 illustrate a sequence of steps for attaching the seat assembly from FIG. 1 to the chair base from FIG. 9.

Referring to FIGS. 12-16, a sequence of steps for attaching the seat assembly 10 to the chair base 82 is illustrated. The seat assembly 10 is first partially lowered onto the chair base 82, with the seat bottom 12 generally oriented at an angle, the forward edge 16 of the seat bottom 12 closer to the chair base 82 than the backstop 28, as shown in FIG. 12. The seat bottom 12 can rest on the forward seat support 92.

Figure 13:
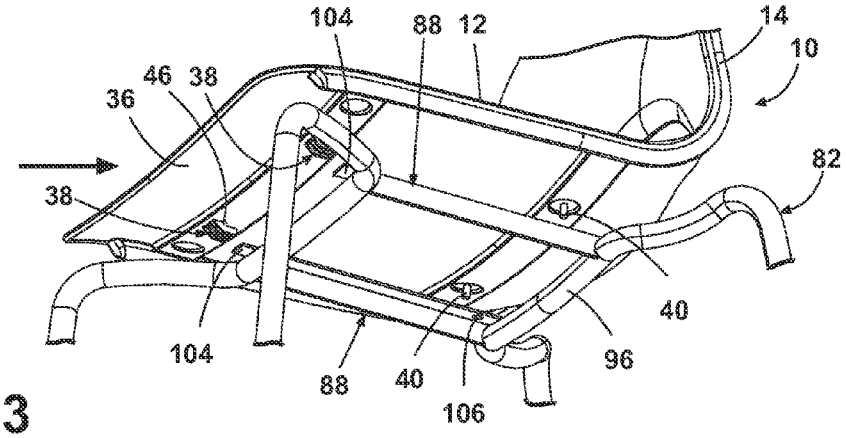

Next, as shown in FIG. 13, the mounting members 38 members are engaged with the extensions 104 by sliding the seat assembly 10 in a generally rearward direction, with the extensions 104 received in the notches 46 adjacent the back surface 36 of the seat bottom 12 and the lateral movement preventer 44. FIGS. 15 and 16 show close-up views of one of the extensions 104 fully engaged with the mounting member 38. The lateral movement preventers 44 assist in aligning the seat assembly 10 properly on the chair base 82, and also prevent the seat assembly 10 from shifting laterally during the remaining steps of attachment and after the seat assembly 10 has been fully attached and the chair 80 is in use.

Figure 14:
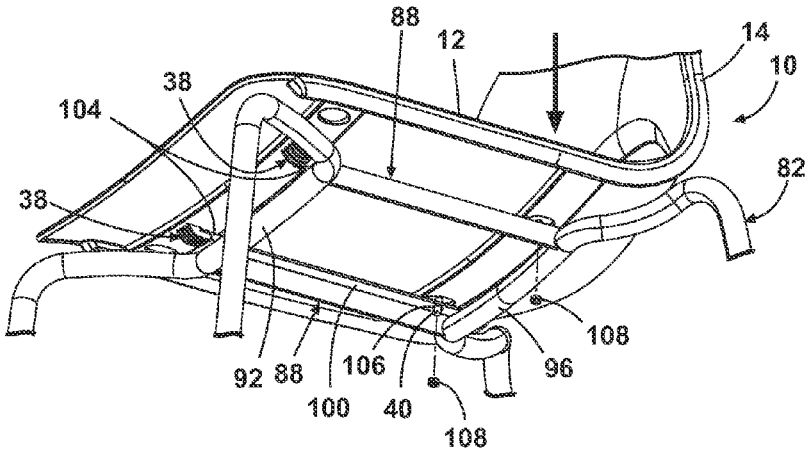

Finally, the seat assembly 10 is fully lowered onto the chair base 82 as shown in FIG. 14. The seat bottom 12 now rests on the rearward seat support 96 as well as the forward seat support 92. The studs 40 are received by the through-holes 106 on the brackets 88 and fasteners 108 are coupled to the studs 40 adjacent the underside of the top wall 100. If the studs 40 are threaded, wing nuts or thumb screws can be used as fasteners 108. It is understood that while each action for attaching the seat assembly 10 to the chair base 82 is described separately, there may be overlap between some actions and some actions may be performed simultaneously.

FIG. 17-19 show a second embodiment of a chair 110 according to the invention having the seat assembly 10 from FIG. 1 attached to the chair base 82, which is substantially identical to the chair base 82 shown in FIGS. 9-16, but differs in construction by comprising arms 112 that are attachable to the chair base 82 without requiring modification of the chair base 82. As such, the attachment of the chair base 82 to the seat assembly 10 can be identical to the sequence of steps shown in FIGS. 12-16, save for the attachment of the arms 112, as described below.

Each arm 112 comprises a tubular arm frame 114 having an arm bracket 116 attached to one end and an armrest 118 attached to an opposite end. Each arm frame 114 includes three integrally formed sections; a first section 120, a second section 122 extending generally orthogonally and upwardly from an end of the first section 120 when view from the front of the base 82, and a third section 124 extending generally orthogonally and rearwardly from an end of the second section 122 when viewed from a side of the base 82. The second section 122 is further inclined relative to vertical when viewed from a side of the chair 110, with an upper end of the second section 122 being forward of a lower end of the second section 122. The armrests 118 are attached to the third section 124 and comprise a cushioned surface on which a user of the chair 110 may rest their arms.

The arm bracket 116 is attached to an end of the first section 120, generally near a midpoint of the bracket 116, by any suitable attachment method, such as by welding. The bracket 116 can comprise a J-shaped bracket having a flat top wall 126, a flat outer side wall 128, and a flat inner side wall 132, where the inner side wall 132 is shorter than the outer wise wall 128. Alternately, the side walls 128, 132 can be generally coextensive in length, in which case the bracket 116 would have a U-shaped cross-section. In either case, the walls 126, 128, 132 define a channel in which the bracket 88 may be received. A through-hole 130 is formed in the top wall 126 near a rear end of the bracket 116, and is configured to receive one of the studs 40 on the seat assembly 10.

Referring to FIGS. 18 and 19, the arms 112 are attached to the chair base 82 prior to attaching the seat assembly 10. The arm brackets 116 are received on the brackets 88, with the top wall 126 resting on the top wall 100 and the outer side wall 128 directly adjacent the side wall 102, as shown in FIG. 19. The inner side wall 132 will depend over the inner edge of the top wall 100 to help hold the arm bracket 116 in place. The through-hole 130 on the arm bracket 116 will generally be aligned with the through-hole 106 on the bracket 88 so that each stud 40 can be received by both through-holes 130, 106. Thereafter, the seat assembly 10 can be attached to the assembled chair base according to the sequence of steps shown in FIGS. 12-16. Alternately, if the seat assembly 10 is already attached to the chair base 82 and it is desired to add arms 112, the fasteners 108 need only be loosened enough to lift the seat assembly 10 off the chair base 82 with enough clearance to slide the arm brackets 116 in place. Thereafter, the seat assembly 10 may be set down and the fasteners 108 tightened once again.

FIG. 20 is a perspective view of a third embodiment of a chair 136 according to the invention having the seat assembly 10 from FIG. 1 attached to a chair base 138. The chair base 138 differs in construction from the previous embodiments by comprising a one-piece frame 140 having two pairs of interconnected legs rather than a two-piece frame having four separate legs. Furthermore, the chair base 138 can be made from a thinner wire frame rather than a thicker tube frame. As used herein, the term "wire" refers to a solid rod material having a small cross sectional shape rather than the shape of the frame itself; e.g., the wire frame is formed from a cylindrical rod material that is formed into the shape illustrated in the drawings.

As illustrated, the one-piece frame 140 includes a right side and a left side that are mirror images of each other. Each side includes a forward leg 142 and a rearward leg 144, where the lower end of the forward leg 142 is connected to the lower end of the rearward leg 144 by an integrally formed floor runner 146. The frame 140 at the junction between the legs 142, 144 and the floor runner 146 is curved such that the forward leg 142 is inclined from vertical in a generally rearward direction and the rearward leg 144 is included from vertical in a generally forward direction. The upper ends of the forward legs 142 are joined by a forward seat support 148 and the upper ends of the rearward legs 144 are joined by a rearward seat support 150. A crossmember 152 extends between the forward legs 142 at a height spaced from the seat assembly 10 and the surface on which the chair 136 rests. The crossmember 152 can by made from a similar wire frame material as the frame 140.

Each floor runner 146 can be provided with a glide 154 that permits the chair 136 to be moved without damaging the flooring surface. As illustrated, each floor runner 146 is provided with two spaced glides 154.

A pair of brackets 178 extend between the forward and rearward seat supports 148, 150. The brackets 178 can have any suitable cross-sectional configuration, such as, but not limited to L-shaped, J-shaped, U-shaped, or flat. As illustrated, the brackets 178 can be flat brackets, with a single wall 180. Other then not having a depending side wall, the brackets 178 can be similar or identical to the brackets 88 shown in FIGS. 10 and 11. Specifically, the brackets 178 have the extension 104 and the through-hole 106 formed on the wall 180. As such, the attachment of the chair base 138 to the seat assembly 10 can be similar, in not identical, to the attachment of the chair base 82 to the seat assembly 10 shown in FIGS. 12-16. Because the attachment of the seat assembly 10 is the same whether used with the tubular frame chair base 82 or the wire frame chair base 138, the seat assembly 10 can be easily transferred between either chair base 82, 138. Furthermore, a manufacturer need only produce one type of seat assembly 10.

Figure 22A:
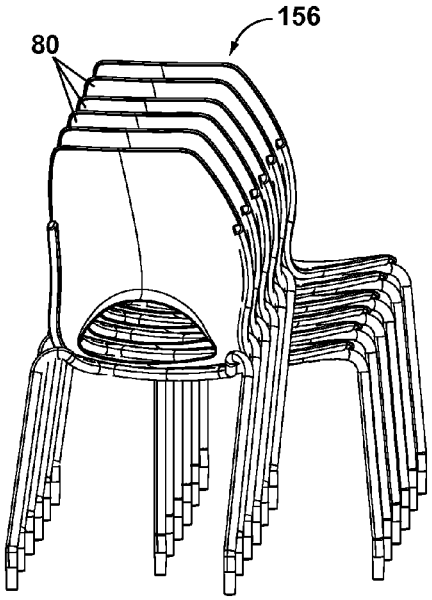
FIGS. 22A-C are schematic illustrations of stacked groups of chairs from FIGS. 9, 17, and 20, receptively.
Figure 22B:
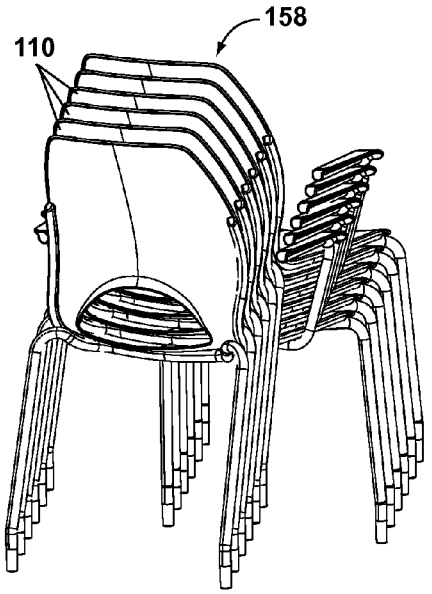
Figure 22C:
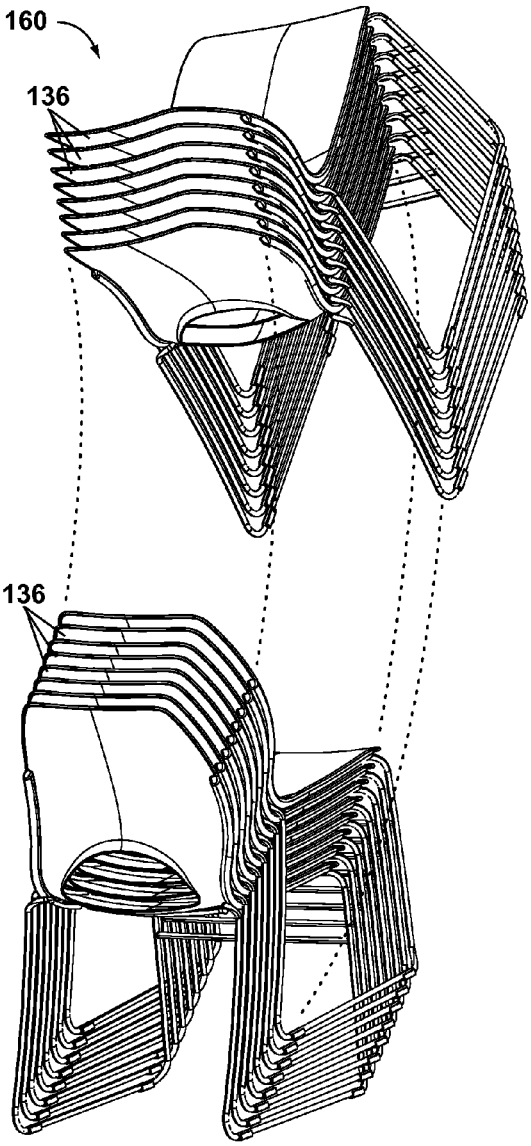

FIGS. 22A-C are schematic illustrations of stacked groups of chairs from FIGS. 9, 17, and 20, receptively. Stacking chairs can generally be divided into two categories: low density stacking chairs and high density stacking chairs. Stacking density can be defined by the number of chairs that can be stacked in a single column. As one example, a low density chair stack may include 2-10 chairs, or more specifically, 6-8 chairs, and all subranges therebetween. A high density chair stack may include over 11 chairs, or more specifically, 35-38 chairs, and all subranges therebetween. Chairs 80 and 110 are configured for low density stacking as shown in FIGS. 22A and 22B, respectively, and chair 136 is configured for high density stacking, as shown in FIG. 22C. As shown in FIG. 22A, six chairs 80 according to the first embodiment can be placed in single stack 156. As shown in FIG. 22B, six chairs 110 according to the second embodiment can be placed in a single stack 158. As shown in FIG. 22C, 38 chairs 136 according to the third embodiment can be placed in a single stack 160, although a portion of the stack 160 is indicated in phantom for clarity purposes. As can be seen in FIG. 22C, the stack 160 begins to curve as more chairs 136 are stacked.

FIG. 23 is a perspective view of a fourth embodiment of a chair 162 according to the invention having the seat assembly 10 from FIG. 1 attached to a swivel-type chair base 164. The chair base 164 comprises a vertical post 166 having legs 168 radiating outwardly from a lower end of the post 166. The ends of the legs 168 include wheels or casters 170 which support the chair 162 on a floor or other surface. The upper end of the post 166 supports the seat assembly 10 for rotatable movement relative to the legs 168, as is common in these types of chairs. The post 166 may be adjustable in length to provide means for adjusting the height of the chair 162. As such, the chair base 164 may be provided with a height adjustment mechanism 172 operably coupled to the post. The details of the height adjustment mechanism 172 are not germane to the invention and will not be described further herein. For example, the height adjustment mechanism 172 may comprise a pneumatic cylinder 174 for adjusting the effective length of the post 166 and a user-engageable actuator 176 for controlling the height adjustment mechanism 172 in a manner well understood by one skilled in the art.

While not illustrated, the chair base 164 has brackets (not shown) which can be similar or identical to the brackets 88 shown in FIGS. 10 and 11 or to the brackets 178 shown in FIG. 21. As such, the attachment of the chair base 164 to the seat assembly 10 can be similar, in not identical, to the attachment of the chair base 82 to the seat assembly 10 shown in FIGS. 12-16. Furthermore, the chair base 164 can optionally be provided with arms 112 as shown and described in FIGS. 17-19.

The seat assembly 10 of the present invention provides ergonomic comfort and fit due to the strong curve of the backstop 28 between the seat bottom 12 and the seat back 14. This strong curve is directed by the curve of the embedded frame 48 and the overmolded chair shell 70.

The seat assembly 10 of the present invention is capable of being easily attached to any suitable chair base, such as the various chair bases shown in FIGS. 9-23. The resulting chair is suitable for use in offices, auditoriums, schools, or any other venue in which chairs are needed. The seat assembly 10 and the chair bases 82, 138 can be thought of as a modular chair system, with the seat assembly 10 being easily transferable between the chair bases 82, 138. Further, the modular chair system can include the optional arms 112.

Some embodiments of the chair are capable of being stacked in a low density or high density arrangement. Other embodiments of the chair have the convenience of a swivel-type base. Further, the low density version and the swivel-type version of the chair are capable of being assembled with or without arms without requiring a modification to the chair base. All of these features offer a versatile product line in which one type of seat assembly can be used with different chair bases, and optionally include armrests.

Providing one seat assembly 10 that can be attached to a low density stacking chair base or a high density stacking chair base is uncommon in the furniture market. It is typical for high density chairs to have the seat assembly integrated with the chair base so that the seat assembly cannot be separated. The inventive one-piece seat assembly is separate from the chair base so that it can easily be transferred between different chair bases. The seat assembly is considered a "one-piece" seat assembly in that it has the seat back integrally formed with the seat bottom, rather than a separate seat back and seat bottom.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A seat assembly for mounting to a chair base to form a chair, the seat assembly comprising:

a singly molded plastic shell having a seat bottom and a seat back extending upwardly from the seat bottom and having at least one mounting member on an underside of the seat bottom for coupling the seat assembly to the chair base, the at least one mounting member having a lateral movement preventer and at least one mounting tooth, wherein the at least one mounting tooth includes a notched flange open in a direction toward the seat back, and the lateral movement preventer includes an unnotched flange for preventing lateral movement of the seat assembly relative to the chair base; and a frame in the shell and having a seat bottom portion and a seat back portion extending upwardly from the seat bottom portion to provide shape and structural support for the seat assembly, whereby the seat assembly is modularly connectable to any chair base having at least one extension located and configured to be received in the at least one mounting member, regardless of the configuration of the chair base.

2. The seat assembly of claim 1 further comprising:

at least one extension attached to an upper portion of the frame;

wherein the at least one mounting member is coupled to the at least one extension.

3. The seat assembly of claim 2 wherein the at least one extension comprises a portion received between the notched flange and the underside of the seat bottom, and the lateral movement preventer prevents lateral movement of the portion in at least one direction.

4. The seat assembly of claim 2 wherein the at least one chair base comprises at least a low density stacking chair base and a high density stacking chair base and the seat assembly can be mounted to either of the low density stacking chair base and the high density stacking chair base without modification of the seat assembly.

5. The seat assembly of claim 2, further comprising an arm removably attached to the chair base and comprising:

a tubular arm frame;

an arm rest provided on the arm frame; and an arm bracket provided on the arm frame and attached to the at least one bracket of the chair base;

wherein the arm bracket can be removably attached to the chair base without modification of the chair base.

6. The seat assembly of claim 5 wherein the arm bracket comprises a top wall and two side walls extending from the top wall to define a channel for receiving the bracket of the chair base.

7. The seat assembly of claim 1 wherein the at least one mounting member includes more than one notched flange.

8. The seat assembly of claim 7 wherein the notched flanges and the unnotched flange are parallel to each other.

9. The seat assembly of claim 1 comprising two mounting members spaced from each other.

10. The seat assembly of claim 1 wherein the frame is integrally formed with the single molded plastic shell.

11. The seat assembly of claim 1 wherein the frame includes a strut and the at least one mounting member is mounted to the strut.

12. The seat assembly of claim 1 wherein the frame is made of steel and embedded into the single molded plastic shell by overmolding.

13. A method for attaching a seat assembly to a chair base, the method comprising:

partially lowering a seat assembly toward the chair base, the seal assembly having a seat bottom, a seat back extending upwardly from the seat bottom, and at least one mounting member on an underside of the seat bottom, the at least one mounting member having a lateral movement preventer and at least one mounting tooth, wherein the at least one mounting tooth includes a notched flange open in a direction toward the seat back, and the lateral movement preventer includes an unnotched flange for preventing lateral movement of the seat assembly relative to the chair base, and the chair base having a bracket with at least one mounting portion corresponding to the at least one mounting member;

inserting the at least one mounting portion into the at least one mounting member by relatively moving the seat assembly and the chair base;

fully lowering the seat assembly toward the chair base; and fixing the position of the seat assembly on the chair base with the lateral movement preventer disposed adjacent to the at least one mounting portion for preventing lateral movement of the seat assembly relative to the chair base.

14. The method from claim 13 wherein partially lowering the seat assembly comprises lowering the seat assembly at an angle, with a forward portion of the seat bottom closer to the chair base than a rearward portion of the seat bottom.

15. The method from claim 13 wherein inserting the mounting portion into the mounting member comprises sliding the seat assembly in a rearward direction relative to the chair base.

16. The method from claim 13 wherein the seat assembly comprises an attachment feature on an underside of the seat assembly and fully lowering the seat assembly comprises inserting the attachment feature into a portion of the chair base.

17. The method from claim 16 wherein fixing the position of the chair base comprises attaching a fastener to the attachment feature to fix the seat assembly on the chair base.

* * * * *